United States Patent [19]

Fromme et al.

[11] 3,979,861

[45] Sept. 14, 1976

[54] TWO-SHEET FOLDING WALL OR FOLDING DOOR OF LAMINAR ELEMENTS

[75] Inventors: Klaus Fromme, Oldenburg; Bruno Schulz, Oberlethe; Bernd Walther, Oldenburg, all of Germany

[73] Assignee: Firma Justin Huppe, Oldenburg, Germany

[22] Filed: Aug. 11, 1975

[21] Appl. No.: 603,615

[30] Foreign Application Priority Data

Aug. 14, 1974 Germany ..... 2438985

[52] U.S. Cl. ..... 52/71; 49/127; 160/118; 160/144; 160/145; 160/199; 160/206

[51] Int. Cl.$^2$ ..... E04B 1/344

[58] Field of Search ..... 52/70, 71; 49/127; 160/199, 233, 144, 234, 145, 136, 159, 162, 130, 118, 206, 84 R

[56] References Cited

UNITED STATES PATENTS

| | | | |
|---|---|---|---|
| 1,481,239 | 1/1924 | Folland | 160/206 |
| 2,027,992 | 1/1936 | Maurer | 160/199 X |
| 2,220,939 | 11/1940 | McGuire et al. | 160/206 X |
| 2,742,084 | 4/1956 | Seymour | 160/84 X |
| 3,029,867 | 4/1962 | Maurer | 160/84 H |
| 3,091,816 | 6/1963 | Wetzel | 52/71 |
| 3,116,782 | 1/1964 | Rudnick | 160/118 X |
| 3,348,628 | 10/1967 | Dixon et al. | 160/84 R |
| 3,811,489 | 5/1974 | Thun et al | 160/118 |

FOREIGN PATENTS OR APPLICATIONS

| | | | |
|---|---|---|---|
| 275,767 | 2/1965 | Australia | 160/84 R |
| 90,625 | 6/1961 | Denmark | 160/206 |
| 229,471 | 11/1907 | Germany | 160/118 |
| 527,456 | 6/1931 | Germany | 160/118 |
| 349,777 | 12/1960 | Switzerland | 160/84 R |

*Primary Examiner*—Price C. Faw, Jr.
*Assistant Examiner*—Leslie Braun
*Attorney, Agent, or Firm*—Olson, Trexler, Wolters, Bushnell & Fosse, Ltd.

[57] ABSTRACT

A two-sheet or double sided folding wall or door includes panel elements which are hinged in pairs along their inner edges to one another. To permit the door to be opened into a configuration wherein the panel elements are longitudinally aligned, and to permit the door to be closed into a fully folded position, horizontal brackets are mounted on at least one of each wall panel element pair. Bracket arms extend at an obtuse angle opposite the element in the closed position. A spring set between the free ends of the two opposing brackets exerts torsional forces around the panel element hinge axes. These forces act in a closing direction in a closed folding wall and in an opening direction in an open folding wall.

9 Claims, 7 Drawing Figures

TWO-SHEET FOLDING WALL OR FOLDING DOOR OF LAMINAR ELEMENTS

BACKGROUND OF THE INVENTION

The invention concerns a double-sided wall or folding door of panel elements which are hinged in pairs along their inner edges to one another and/or to vertical mounting strips. These panel elements are suspended in a ceiling runner and are horizontally movable, with the elements belonging to one wall side lying in a single plane when the folding wall is in a closed condition.

In usual current folding walls, the hinge-squares formed by opposing element pairs remain rhombic-shaped in cross section and the folding wall sides are therefore uneven even in the wall closed condition. Folding walls of the type considered here have the advantage that in the closed position they provide a flush wall appearance or character interrupted only by vertical grooves in the area of the necessarily resilient mounting strips. "Pulling flush" such folding walls does, however, involve difficulties both in closing and opening movement. As long as all the hinge axes of closed folding wall side elements lie in one plane (desirable for both constructional and esthetic reasons), there is no momentum available for swinging the elements open, when wall folding or opening is desired, because the opening force runs in the planes of the elements themselves. The same holds true for wall closing, where the force necessary for putting the elements into the side planes is lacking, because they are vertical to the closing tension exerted in those side planes.

Up until now, therefore, special measures have had to be taken to overcome these difficulties, and these measures have been taken at the expense of production cost, operational simplicity and safety, as well as the external appearance of the folding wall.

The basic object of the invention is to create a "flush-extending" folding wall which affords a maximum of operational safety with simple construction and attractive appearance.

The present invention accomplishes this object by mounting horizontal brackets on at least one element of each wall panel element pair, and between two mounting strips, or on the elements opposite each other. These horizontal brackets have inwardly offset bracket arms, which in each case lie approximately on the hinge axis between the element and the mounting strip. The bracket arms extend at an obtuse angle opposite the element in the closed position of the folding wall into the area of the mounting strip. By having a spring set between the free ends of the two opposing brackets, torsional forces are exerted around the hinge axes on the wall elements. These forces act in a closed folding wall in the closing direction; in an open folding wall, the forces act in the opening direction. When the free ends of the bracket arms to which the spring is attached are in the closed position, the arm ends are on one side of a plane that runs through the two opposing hinge axes vertical to the wall plane. When the free ends of the bracket arms are in the open position, they are located on the other side of this plane. In other words, the arms are oriented in such a way that the free arms ends lie outside of the cross section quadrangle bounded by the involved elements when the folding wall is in its closed position. In this way, of course, the spring produces torsional force in different directions around the hinge axes in the wall closed position and in the wall open position, despite the constant effective direction of the force of the spring.

If the folding wall is open, the individual panel elements lie in planes vertical to the wall plane, and the two brackets associated with the wall element pair (which in the closed condition of the folding wall face each other), now lie generally in one of these vertical planes. The brackets extend diagonally with bracket arms — homologously opposed — out of that wall element plane, and the spring acting between the free ends of the bracket arms exerts a torsional force around the hinge axes around which the two elements are hinged to pivot on the respective mounting strip so as to maintain this vertical attitude. The elements cannot swing past the vertical plane position, because their front edges facing the mounting strip come to rest on the strip outer side surface.

When the folding wall begins to close, the spring forces, which keep the elements tensioned in their transverse position as described above, are immediately overcome, although as the elements begin their turns out of the transverse position into the wall or panel planes, the spring forces at first even increase. This is due to the fact that the brackets swing with the wall elements, and their free ends pass through an unstable dead-center position in the course of this swinging movement in which the spring force is greatest but acts neither in the closing direction or in the opening direction.

This dead-center position occurs when the bracket arms are at less than 135° to the elements, and when the elements have reached a 45° position with reference to the panel plane, that is, when the folding wall is half closed. In this position the bracket arms are about in the above-described plane passing through the two opposing hinge axes. If the folding wall is pulled farther into its closed position, each spring exerts a torsional force on the brackets, and thus on the elements, which is exerted in the open position and forces the elements into the closed position in which they find themselves within the given plane of the panels.

There is of course no difficulty in swinging the elements of the wall beyond the dead-center point into the open position with a mere push against the closing force of the spring, as long as the elements are not yet completely in the closed position. But for the reasons given above, the opening of the folding wall or of its individual sections formed of any two facing element-pairs is theoretically impossible as soon as the elements are swung completely into their panel plane. However, it was found that this theoretical impossibility actually does not occur in practice, because of inevitable wall component and installation irregularities. Just a slight displacement of the individual hinge axes with respect to the common panel plane suffices to make possible the opening of the individual folding wall sections against the closing forces exerted by the springs in this position.

In order to simplify and facilitate opening the closed folding wall, a refinement of the invention provides pushers. These pushers exert a pressure on the bracket arms within the wall plane, and the arms correspondingly exert torsional forces directed against the spring force. In this way the brackets receive an "initial impulse" which swings each associated element out of its closed position. As previously stated, even a relatively slight oblique posture of the elements vis-a-vis their panel planes suffices to bring about further wall opening action without any trouble.

The pushers can act particularly and directly on the springs, and a wall can be equipped with an actuating device on the front end for its opening. A pusher can be operationally connected with the actuating device to energize the spring situated in the area of the foremost mounting strip, while the activation of the rest of the pushers takes place in each case through the advance of the mounting strips in the opening direction as the wall moves. In this way, when the wall is opened first its foremost section consisting of two opposing element pair is completely opened, then the next one, then the third, etc., while any not yet opened sections remain in their closed position. With the traditional folding doors equipped with so-called "Nuremberg Shears," on the other hand, all folding wall sections are moved simultaneously.

Figure 1:
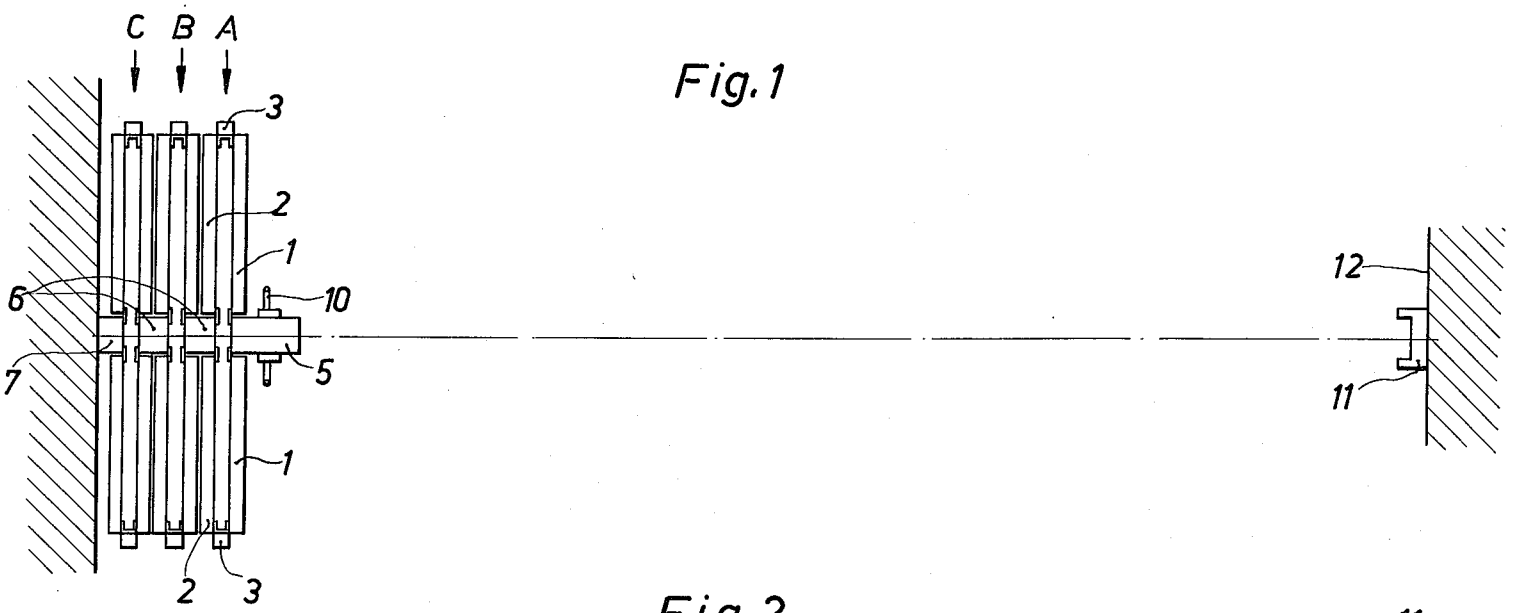
FIG. 1 shows a schematic cross section through a folding wall reposing it on opened position according to the invention.
Figure 2:
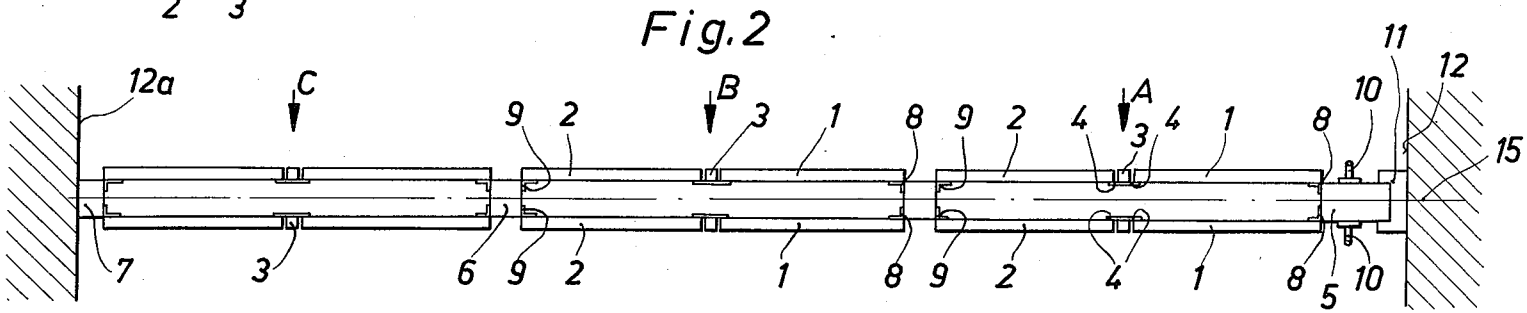
FIG. 2 shows a wall cross section corresponding to FIG. 1, but showing the wall in the closed position.

The folding wall illustrated schematically and with omission of details in FIGS. 1 and 2 consists of three sections, A, B and C. Each section consists of two pairs of panel-shaped elements 1, 2. In each case, one element-pair 1, 2 belongs to one panel and the other element-pair 1, 2 (of the same section) belongs to the other panel. Although the two elements 1, 2 of a pair can be hinged directly to each other, in the example in each case an intermediate strip 3 is installed, to which on the one side element 1 is hinged; on the other strip side element 2 is hinged. In the closed wall position, the strip 3 lies in the line of the panel plane parallel to the wall plane 4. In the wall-open position, the strip 3 assumes the relative position seen in FIG. 1. Vertical hinge axes 4 lie between the elements 1, 2 and the intermediate strip 3.

Along their other vertical edges the elements 1, 2 are articulated to vertical mounting strips 5, 6, 7 respectively. Hinge axes 8 of elements 1 are formed with the mounting strips and the hinge axes 9 of the elements 2 are formed with the mounting strips. The mounting strips 5, 6, 7 hang on rolling trucks or gliders which are carried in known fashion in a ceiling rail and in this way make the mounting strips horizontally mobile; this suspension is not shown.

Intermediate mounting strip 6 is differentiated from mounting strip 5 by the fact that strip 5 is in the front end of the whole folding wall, and is equipped with an activating device 10 for opening of the folding wall. Also, mounting strip 5 in the closed position of the folding wall fits into a mating retainer 11 on a wall 12.

The folding wall is fastened to room structure with the mounting strip 7 attached to the rear end of the folding wall.

Figure 3:
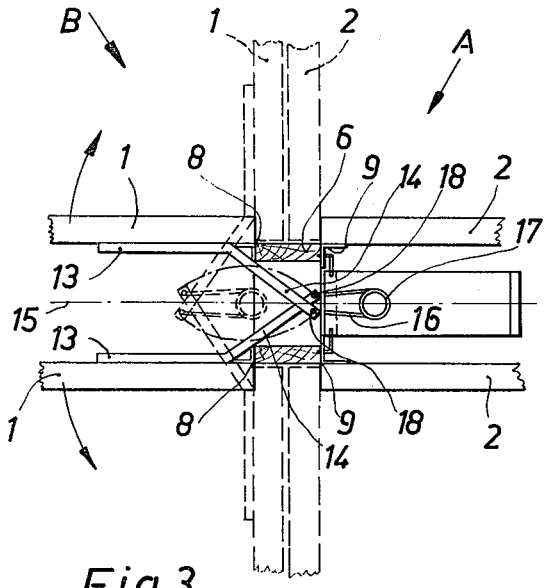
FIG. 3 shows an enlarged section of FIG. 2 in the area of a mounting strip.
Figure 4:
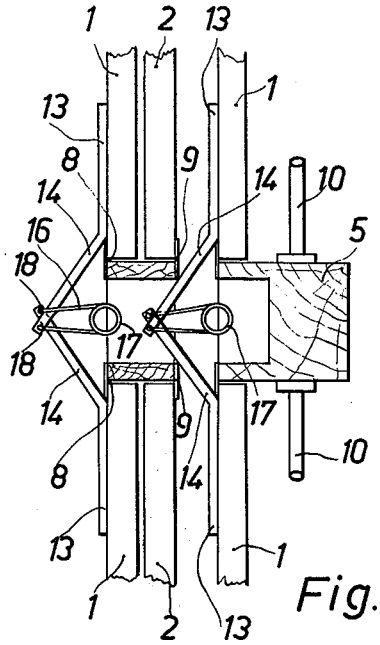
FIG. 4 shows a section from FIG. 1 corresponding to FIG. 3.
Figure 5:
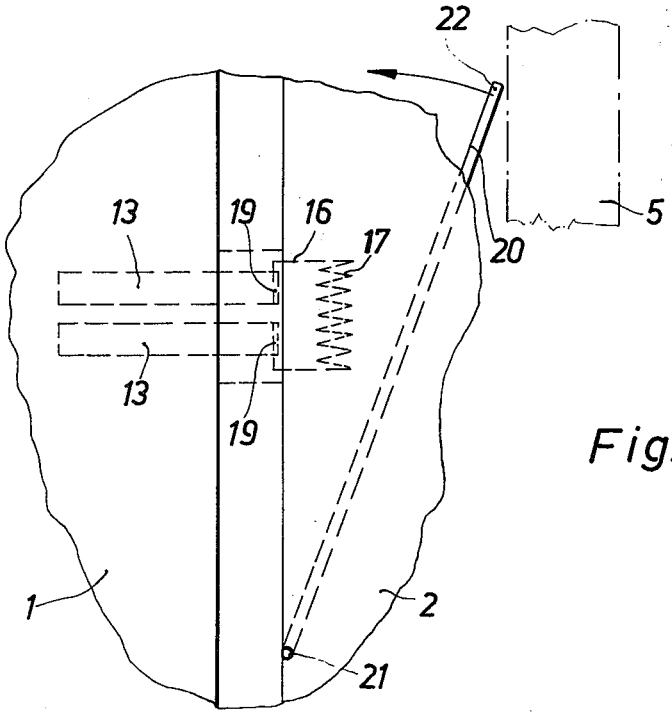
FIG. 5 shows a side view section of the apparatus presented in FIG. 3.
Figure 7:
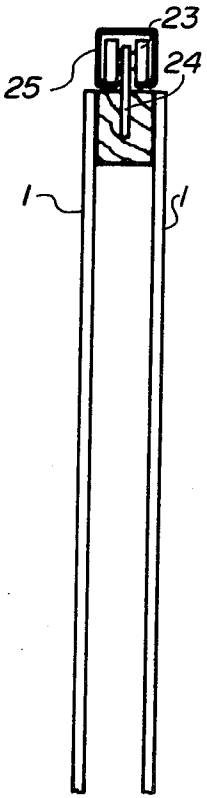
FIG. 7 is a vertical sectional view taken substantially along the line 7—7 in FIG. 6.
Figure 6:
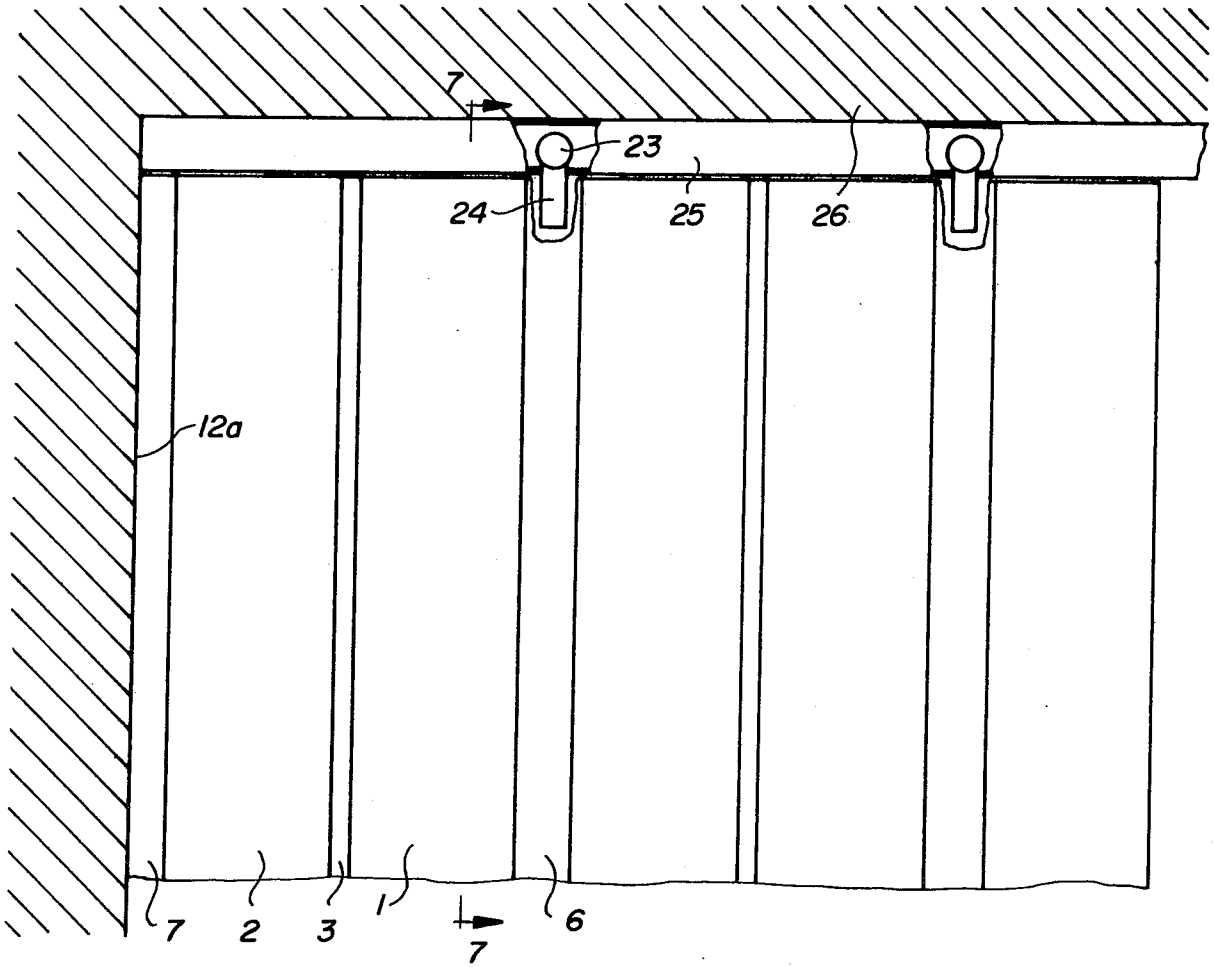
FIG. 6 is a fragmentary vertical front view of the folding wall substantially at right angles to FIG. 2 with the fixed wall and ceiling shown in section.

While in FIGS. 1 and 2 the construction of the folding wall in the area of the mounting strips is not depicted in detail, FIGS. 3 to 5 illustrate important construction in the area of a mounting strip 6; the construction in the area of mounting strip 5 is essentially the same. The hinge axes 8 and 9 are like hinge axes 4, formed of linen strips which are glued or otherwise attached behind the elements 1, 2 to the hidden inner surfaces of mounting strip 6. At a half-way or other suitable point up the elements 1, 2 brackets 13 are attached to the opposing elements 1 which belong to the same section B. The brackets 13 have arms 14 bent at a 45° angle which accordingly—in a mirror image to wall plane 15—lie at 135° to the plane of the elements 1. The arrangement is such that the bracket arms 14 lie along the hinge axes 8 and extend into a recess (not shown in detail) in the mounting strip 6. In order to obtain the longest possible lever arms, the bracket arms 14 of the brackets 13 are offset in height to each other as in FIG. 5 and cross each other. Therefore the initial stressing force of the torsion spring 17 is exerted on the free ends 18 of the bracket arms 13 in a door-closing direction. FIG. 5 shows schematically how the likewise offset arms 16 of the spring 17 are bent opposite each other vertically. The spring arm tips form pins which are accepted in correspondingly shaped holes in the free ends 18 of the bracket arms 14.

Two dashed arms in FIG. 3 indicate the path traversed by the bracket arm free ends 18 when the elements 1 swing around the hinge axes 8 into their open position as the door is opened. In this position, the bracket arm free ends lie in a common plane running vertical to the wall plane. The end position shown by dashes in FIG. 3 is clearly seen in FIG. 4. A comparison of these two figures shows how the free ends 18 of the bracket arms 14 have moved out of their position shown in FIG. 3, in which they are on the right of the plane through the hinge axes 8, into a position on the left of this plane. In this position (FIG. 4) the open spring 17 holds the elements 1 in the open position, and with them the articulated elements 2 of the same section. The same spring 17 in the position shown in FIG. 3 presses the associated elements 1 and 2 into the closed position.

Underneath the arrangement consisting of the brackets 13 and the spring 17 a pusher 20 in the form of a lever is hinged at 21 on the mounting strip 6, which is held ready in the inoperative position shown in FIG. 5. If the preceding mounting strip—in the example, mounting strip 5—moves when the door is opened, the pusher free end 22 abuts the mounting strip 5; continued door movement presses the pusher end 22 on the spring 17. The pressure on the spring 17 moves it, in turn, through the recess in the mounting strip 6 and permits the elements 1 to swing open under the action of the bracket 13 and against the force of the spring 17. In similar fashion, a pusher is located inside the foremost mounting strip 5 which presses in the opening direction on the corresponding spring 17 upon energization of the activation device 10. It goes without saying that not only several of the arrangements consisting of the brackets 13 and the spring 17 can be distributed vertically, but that this is also true in regard to mirror arrangement acting on the elements 2.

The folding wall is supported by means of rollers 23 joined to the wall by means of hangers 24 secure to the mounting strips between channels. The rollers 23 are received in an inverted flanged channel 25 secured to the underside of the ceiling, all in generally conventional fashion.

The invention is claimed as follows:

1. A folding wall comprising a plurality of panel elements hinged, in pairs, along their inner edges to one another and being suspended from a ceiling runner for horizontal motion along the runner, a plurality of vertical mounting strips hinged to the panel elements, the panel elements forming one folding wall side lying in a single plane when the wall is in a closed condition, substantially horizontal brackets attached to at least one panel element of each panel element pair between two mounting strips, the horizontal brackets each including homologously inwardly offset bracket arms extending across a panel element hinge axis located between adjacent panel elements and the connecting mounting strip, the bracket arms further extending into the mounting strip area at an obtuse angle to the panel element when the door is closed, and spring means located between the free ends of facing brackets, the spring means exerting a torsional spring force on the brackets and on the elements around the hinge axes, a torsional spring force acting in a closing direction in a closed folding wall, and acting in an opening direction in an open folding wall.

2. A folding wall according to claim 1, wherein the brackets are vertically offset on opposing elements and wherein said bracket arms are crossed.

3. A folding wall according to claim 1 wherein said spring is a torsion spring.

4. A folding wall according to claim 3, including torsion spring ends attached to bracket arm ends so as to cause spring end-bracket end pivoting motion around vertical axes.

5. A folding wall according to claim 1, including pushers for exerting pressure on the bracket arms within the wall plane in the opening direction, said pressure creating torsional forces on the brackets in a direction opposed to the spring force.

6. A folding wall according to claim 5 wherein the pushers act directly on the springs.

7. A folding wall according to claim 6, including activating means for opening the wall, and wherein a pusher is in operational contact with the activating means, the pusher acting on the spring installed in the area of the foremost mounting strip.

8. A folding wall according to claim 6 wherein activation of each pusher takes place through the advance of the mounting strip in the opening direction.

9. A folding wall according to claim 8 wherein the pusher is a lever on the mounting strip penetrated by the respective spring and pivotable around a axis running verticaly to the wall plane and which, in the inoperational position, forms an acute angle with the mounting strip and lies close to the spring, the pusher lever having a free end tipped toward the advancing mounting strip so that when the advancing mounting strip approaches, the mounting strip engages the lever and presses the lever against the spring.

* * * * *